US010436556B1

(12) United States Patent
Ohlau

(10) Patent No.: US 10,436,556 B1
(45) Date of Patent: Oct. 8, 2019

(54) ARROWHEAD

(71) Applicant: Kurt S. Ohlau, Cerro Gordo, IL (US)

(72) Inventor: Kurt S. Ohlau, Cerro Gordo, IL (US)

( * ) Notice: Subject to any disclaimer, the term of this patent is extended or adjusted under 35 U.S.C. 154(b) by 696 days.

(21) Appl. No.: 14/799,184

(22) Filed: Jul. 14, 2015

Related U.S. Application Data

(60) Provisional application No. 62/078,223, filed on Nov. 11, 2014.

(51) Int. Cl.
*F42B 6/08* (2006.01)

(52) U.S. Cl.
CPC ..... *F42B 6/08* (2013.01)

(58) Field of Classification Search
CPC ..... F42B 6/08
See application file for complete search history.

(56) References Cited

U.S. PATENT DOCUMENTS 2,568,417 A * 9/1951 Steinbacher ..... F42B 6/08 473/583
3,578,328 A * 5/1971 Rickey ..... F42B 6/08 473/583
4,166,619 A * 9/1979 Bergmann ..... F42B 12/362 30/161
D279,813 S * 7/1985 Palizzolo ..... D22/115
4,940,246 A * 7/1990 Stagg ..... F42B 6/08 473/583
5,178,398 A * 1/1993 Eddy ..... F42B 6/08 473/583
5,458,341 A * 10/1995 Forrest ..... F42B 6/08 473/583
6,171,206 B1 * 1/2001 Liechty, II ..... F42B 6/08 473/583
7,234,220 B1 * 6/2007 Grace, Jr. ..... F42B 6/08 29/428
7,377,869 B2 * 5/2008 Wohlfeil ..... F42B 6/08 473/583
D583,897 S * 12/2008 Ward ..... D22/107
8,435,144 B2 * 5/2013 Asherman ..... F42B 6/08 473/583
8,449,416 B2 * 5/2013 Grace ..... F42B 6/08 473/583

OTHER PUBLICATIONS

Letter dated Apr. 9, 2015, from an attorney representing Arrow Dynamics LLC, received by applicant's attorney, which includes photographs of broadheads, and a forum from Broadheadtalk.com dated 2010.*

* cited by examiner

*Primary Examiner* — John A Ricci
(74) *Attorney, Agent, or Firm* — Philip L. Bateman

(57) ABSTRACT

A mechanical broadhead arrowhead having a plurality of delayed deployment blades pivotably connected to the body of the arrowhead. Each blade has a longer knife portion and a shorter wing portion. The wing portion has a sharpened edge along at least part of the side facing the knife portion. The blade has a pivot point where the centerlines of the knife portion and wing portion intersect.

8 Claims, 9 Drawing Sheets

10
20
50
30
40

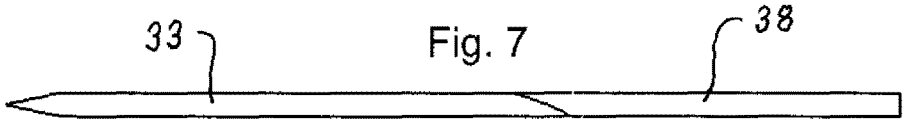
Fig. 7
Fig. 8
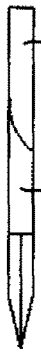
Fig. 10
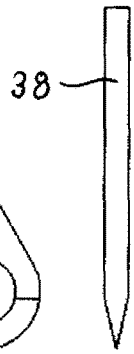
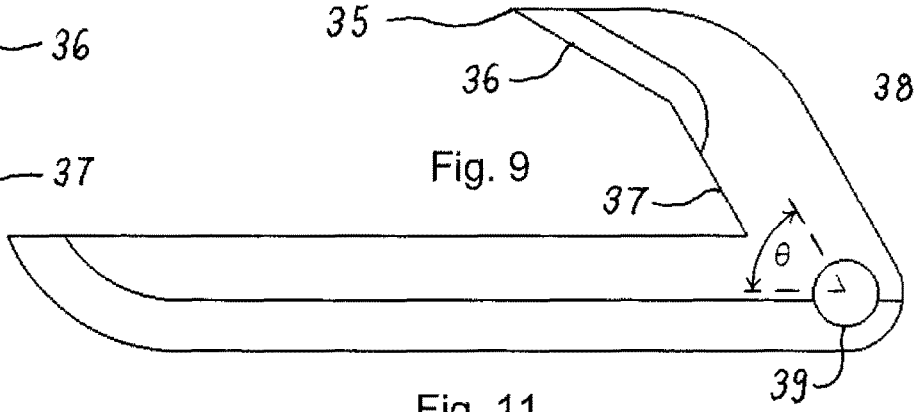
Fig. 9
Fig. 11
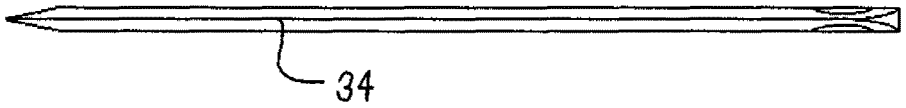

130

ARROWHEAD

CROSS-REFERENCE TO RELATED APPLICATION

This application claims the benefit of U.S. Provisional Application Ser. No. 62/078,223, Nov. 11, 2014.

FIELD OF THE INVENTION

This invention relates to archery. More particularly, this invention relates to arrowheads for hunting.

BACKGROUND OF THE INVENTION

The sport of shooting with a bow and arrow is known as archery. The bow and arrow were first used in prehistoric times for hunting and warfare. Firearms have long since replaced the bow and arrow for warfare and for most types of hunting. However, the bow and arrow continue to be used for target shooting and for some types of hunting. For example, hunting deer with the bow and arrow is popular in the United States.

The first arrows were wooden shafts with a sharpened tip. Man discovered that the effectiveness of the arrow was enhanced by fastening an enlarged arrowhead on the forward end of the arrow. Early arrowheads were made of stone or horn. Modern arrowheads are made of steel or other materials that are more durable, easier to manufacture, and sharper. Arrowheads with two to four blades about the arrow shaft axis are known as broadheads and are commonly used for hunting. Broadheads deliver a wide cutting edge to cause increased trauma to the internal organs and a more rapid death to the animal, which is considered more humane.

Two types of broadheads are used by hunters, those with fixed blades and those with movable blades. Broadheads with movable blades are commonly known as "mechanical" broadheads. Mechanical broadheads are more streamlined in flight (i.e., they create less drag/wind resistance) and contain blades that either deploy on contact or after contact. A mechanical broadhead is considered to deploy on contact if the forward-most part of the blade is exposed and the first contact of the blade with the target is made by this part. A mechanical broadhead is considered to deploy after contact if when the arrowhead enters the animal, the forward-most, knife portion of the blade penetrates to a certain depth prior to which an outwardly-extending wing (also known as a flange, lug, finger, spur, or lever) makes contact. When the wing makes contact, it is pushed back and the knife portion is deployed. The arrow then continues to travel forward with the knife portion deployed.

Mechanical broadheads with blades that deploy on contact are disclosed in Liechty II, U.S. Pat. No. 6,171,206, Jan. 9, 2001 and Grace et al., U.S. Pat. No. 8,449,416, May 28, 2013. Within this group of mechanical broadheads having blades that deploy upon contact are lesser desirable qualities including: the tendency to deflect on highly angled shots; loss of kinetic energy from cutting through bone, generally the ribs, by being fully deployed as they penetrate the exterior of the target animal (the hair, hide, and ribcage) before reaching the internal organs; and dulling of the cutting edge as a result of cutting through bone.

Mechanical broadheads with blades that deploy after contact are commonly known as delayed deployment broadheads. Delayed deployment pivoting blades are disclosed in Steinbacher, U.S. Pat. No. 2,568,417, Sep. 18, 1951; Rickey, U.S. Pat. No. 3,578,328, May 11, 1971; Bergmann et al., U.S. Pat. No. 4,166,619, Sep. 4, 1979; Palizzolo, U.S. Pat. No. Des. 279,813, Jul. 23, 1985; Stagg, U.S. Pat. No. 4,940,246, Jul. 10, 1990; Eddy, U.S. Pat. No. 5,178,398, Jan. 12, 1993; Forrest et al., U.S. Pat. No. 5,458,341, Oct. 17, 1995; Wohlfeil et al., U.S. Pat. No. 7,377,869, May 27, 2008; Ward, U.S. Pat. No. D583,897, Dec. 30, 2008; and Asherman, U.S. Pat. No. 8,435,144, May 7, 2013. The blades of these broadheads have elongated knife portions that are aligned parallel with the arrow axis during flight and shorter wing portions that are set back from the tip and that extend outwardly during flight. When the broadhead enters an animal to a depth that the wing portions make contact, the blades pivot. The pivoting movement causes the wing portions to move back to a position that is close to parallel with the arrow axis and the knife portions to move outwardly. This pivoting movement is highly desirable because it enables the shorter wing portions to extend during flight (thereby creating less drag) and the longer knife portions to deploy within the animal (thereby creating greater trauma).

The leading edge of the wing portion of the Eddy, Forrest et al., and Ward blade is sharpened whereas the leading edges of the wing portions of the other blades are dull. The wing portion of the Eddy, Forrest et al., and Ward blade is positioned forward of the pivot point of the blade. This position causes a spreading action upon deployment that creates unnecessary energy loss. Additionally, for the Eddy and Forrest et al. blade, the short straight sharp leading edge of the wing portion is at such an angle, nearly perpendicular to the axis, that it tends to inefficiently "blow through" the tough exterior (the hair, hide, and ribcage) rather than more efficiently cut through it. Furthermore, for the Ward blade, the leading edge of the wing portion is at such an angle that this blade will wedge between 2 ribs on entry causing the blade to cut through bone and lose energy.

Although these delayed deployment mechanical broadheads provide some improvement in conserving energy though the tough exterior of the target animal, there are unique qualities to each that are less than optimal. Accordingly, a demand exists for a mechanical broadhead with delayed deployment blades providing optimal energy conservation through the tough exterior of the target animal while utilizing efficient cutting techniques upon entry into the target animal.

SUMMARY OF THE INVENTION

The general object of this invention is to provide an improved mechanical broadhead arrowhead.

I have invented an improved mechanical broadhead arrowhead. The arrowhead comprises: (a) an elongated body defining a longitudinal axis, the body having a forward end with a sharpened tip, a threaded rearward end for attachment to a shaft of an arrow, and a plurality of recessed slots parallel to the longitudinal axis; and (b) a plurality of delayed deployment blades pivotably mounted in the slots, each blade having a longer knife portion with a centerline and a shorter wing portion with a centerline, the knife portion having a sharpened edge along the side opposed from the wing portion, the wing portion having a sharpened edge along at least part of the side facing the knife portion, each blade having a pivot point where the centerline of the knife portion intersects the centerline of the wing portion, each blade adapted to rest in a first position with its knife portion in a slot of the body and with its wing portion extending outwardly with its sharpened edge facing forward during flight, and each blade adapted to move to a second position with its wing portion in a slot of the body and its knife portion extending outwardly with its sharpened edge facing forward after deployment upon contact with a solid target.

The arrowhead of this invention demonstrates improved energy conservation through the tough exterior of the target animal and utilizes improved cutting techniques upon entry into the target animal.

BRIEF DESCRIPTION OF THE DRAWINGS

FIG. 7 is a top plan view thereof.

FIG. 8 is a front elevation view thereof.

FIG. 9 is a right side elevation view thereof.

FIG. 10 is a rear elevation view thereof.

FIG. 11 is a bottom plan view thereof.

DETAILED DESCRIPTION OF THE INVENTION

1. Introduction

Figure 1:
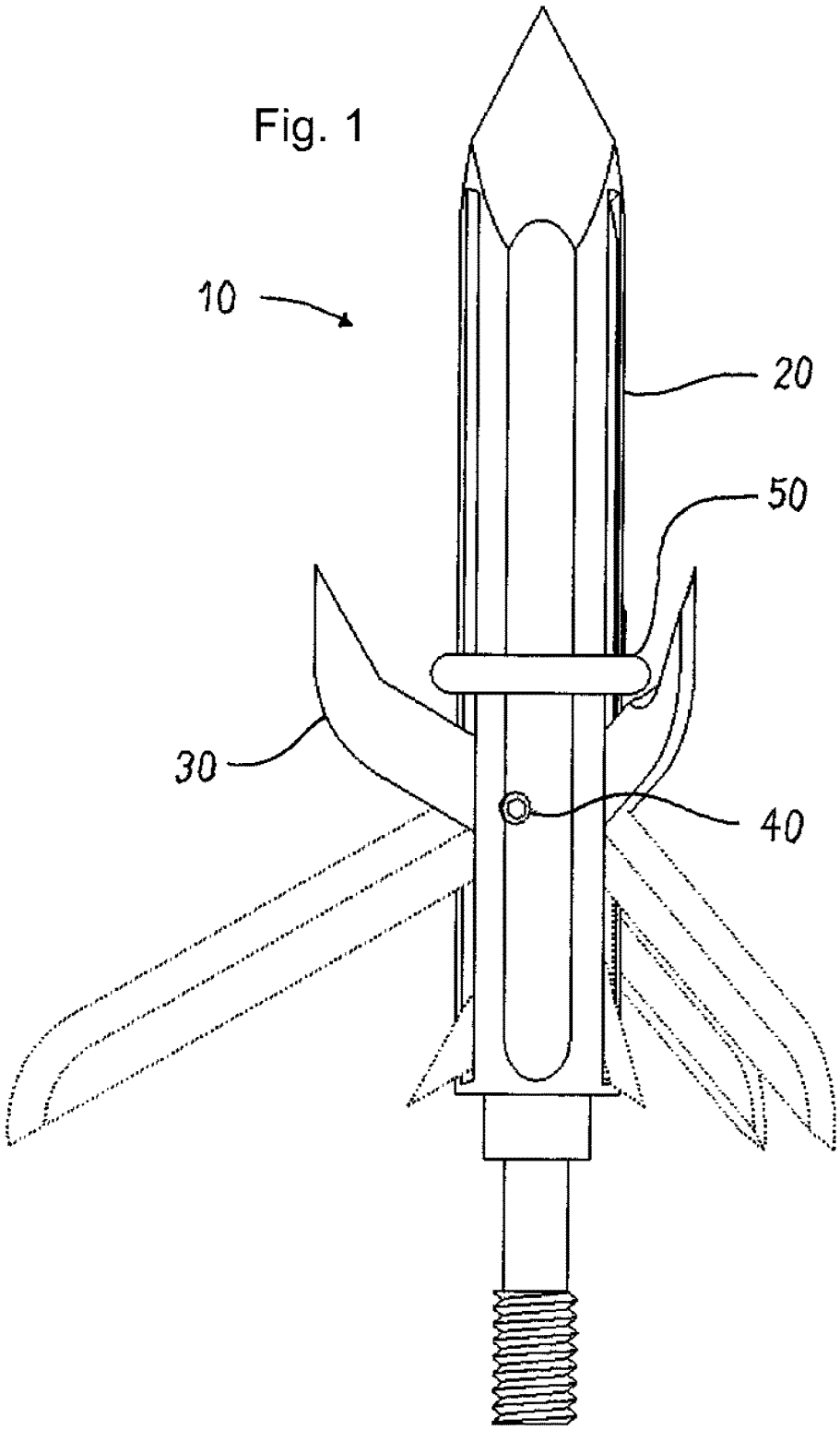
FIG. 1 is a top plan view of a first preferred embodiment of the arrowhead of this invention with the blades in an in-flight position shown in solid lines and with the blades in a fully-deployed position shown in broken lines.
Figure 2:
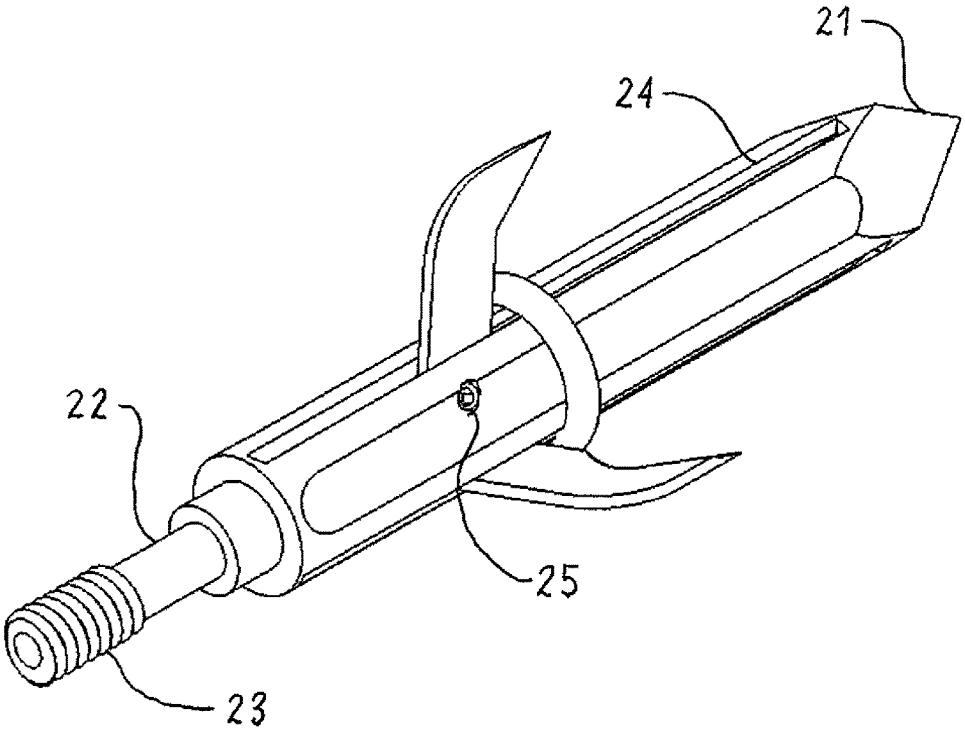
FIG. 2 is a perspective view thereof with the blades in an in-flight position.

The arrowhead of this invention is of the broadhead type (it has blades about the arrow shaft axis), is of the mechanical type (its blades deploy from a first position to a second position), and is of the delayed deployment type (the forward most point of the blade penetrates to a certain depth and is then deployed by means of wing). Referring first to FIGS. 1 to 4, a preferred embodiment of the arrowhead 10 of this invention comprises a body 20 with recessed slots, a plurality of J-shaped blades 30 held in place in the slots with set screws 40, and a rubber O-ring 50. Each blade has an elongated knife portion (sometimes known as the shank) and a shorter wing portion. The arrowhead is attached to the shaft of an arrow (not shown). These components are discussed in more detail below.

2. The Body

The body of the arrowhead is elongated and is generally cylindrical. The term "generally cylindrical" is used herein to mean that the cross-section of the body defines a partial or full circle at the maximum radius from the longitudinal axis. Non-cylindrical bodies (those having cross-sections that are triangular, rectangular, etc.) are also suitable. The body defines a longitudinal axis that is collinear with the axis defined by the shaft of the arrow to which it is attached.

The forward end of the body has a sharpened tip 21 for penetrating the target animal. In the embodiment shown, the tip is formed by the convergence of three planes that allow the length of the recessed slots to be maximized. Conical tips, tips accepting an additional blade or blades, tips of a different material, and tips of other shapes are also suitable.

The rearward end of the body has a means for attachment to a shaft of the arrow. In the embodiment shown, the means for attachment is a cylindrical extension 22 having a male threaded section 23 at its distal end that fits into a mating recess in the forward end of an arrow.

The body contains a plurality of recessed slots 24 running parallel to its longitudinal axis. The slots hold a portion of the blades—the longer knife portions in the in-flight position and the shorter wing portions in the deployed position. Upon entry, the slots serve to protect the longer knife portion of the blade from any possible damage. The number of slots is generally two to four. The preferred embodiment shown contains three slots that are equally spaced apart at 120 degrees.

The body contains transverse threaded holes 25 running from the exterior surface into each recess. As explained in more detail below, the transverse threaded holes are for attaching the blades.

The body preferably contains a plurality of flutes 26 (recesses) running most of the length of the body. The flutes reduce the cross sectional area of the body which results in reduced drag while moving through the target animal.

The body preferably contains one or more transverse indentations 27 running around the circumference of the body. As explained in detail below, one of the indentations holds a rubber O-ring that, in turn, holds the blades in the in-flight position until a target is entered.

The body is made of a durable material that is capable of holding a sharp point. Various metals and thermoplastics are suitable. The preferred material is aluminum. The size of the body is a matter of choice. The body is generally about 2 inches (about 50 mm) in length (not including the length of the cylindrical extension and male threaded section) with a diameter of about five-sixteenths inch (about 8 mm).

3. The Blades

The preferred embodiment of the broadhead arrowhead contains three blades. Arrowheads with two and four blades are also suitable. One blade is not suitable because of the unbalanced weight and more than four blades are not suitable because of size limitations. Referring now to FIGS. 5 to 11, the preferred embodiment of each blade has the general shape of a sans serif capital letter J with a longer knife portion 31 and a shorter wing portion 32. The side 33 of the knife portion facing the curved portion is preferably flat (or rounded or otherwise non-sharpened) while the side 34 of the knife portion opposed from the curved portion has a sharpened edge because it becomes the leading edge after the blade is deployed upon entering a target.

The wing portion of the blade has a distal point 35 that is directed parallel to the knife portion and to the longitudinal axis of the body when the blade is in the in-flight position. The distal point being parallel to the longitudinal axis provides very efficient cutting upon entry as a result of the energy of the arrow being focused on a point of the blade rather than a complete edge of the blade. The distal end 36 of the wing portion facing the knife portion has a sharpened edge because it is the leading edge after the distal point 35 first contacts the target. The proximate end 37 of the wing portion facing the knife portion is preferably flat (or rounded or otherwise non-sharpened) so that it provides the resistance for the blade to deploy. However, the proximate end is also sharpened if desired.

The action of piercing by the distal point 35 and then cutting by edge 36 as the blade pivots to a deployed position is the basis for conserving energy through the tough exterior of the target animal while utilizing efficient cutting techniques upon entry into the target animal. The efficient cutting technique is a result of the point and edge not cutting through a bone (generally the ribs), but rather moving around the bone while pivoting to a deployed position. Cutting through a bone is undesirable because it results in a massive loss of energy. This action is described in more detail below. The side 38 of the wing portion opposed from the knife portion is preferably flat (or rounded or otherwise non-sharpened) to prevent cuts as the arrowhead is handled.

Each blade has a pivot point hole 39 where the centerline of the knife portion intersects the centerline of the wing portion. A centerline is a line equidistant from the two sides. A centerline continues in its last direction after the knife portion and the wing portions end. The term "intersects" means that the lines intersect exactly or about exactly. The intersection of the centerlines is shown in FIG. 9. The angle θ formed by the intersection is generally about 45 to 75 degrees and is most preferably about 60 degrees. This angle also determines the swept back angle (the angle formed by the leading edge of the knife portion after deployment). A set screw 40 passes through the pivot point and extends between opposing sides of the recess to hold the blade in place and to allow it to pivot from the in-flight position to the deployed position.

4. Second Embodiment of the Blades

A second embodiment of the blade 130 is shown in FIGS. 12 to 18. Like the first embodiment, the second embodiment has a longer knife portion 131 and a shorter wing portion 132. The second embodiment differs from the first embodiment in that the side of the wing portion facing the knife portion is straight and is sharpened along a greater percentage of its length. The second embodiment is not as efficient as the first embodiment in piercing the tough exterior of the target animal, but is easier to manufacture and is slightly more durable.

5. Manufacture

The body and the blades are generally manufactured separately using conventional methods. The blades are then attached to the body by inserting set screws that pass through the body and through the pivot points. The blades are then oriented so the knife portions are in the recesses and facing toward the front of the arrowhead. A rubber O-ring 50 is then slid from the tip of the body down to the desired indentation. The O-ring holds the blades in the in-flight position until the arrowhead enters a target.

The arrowhead is then mounted onto an arrow by inserting the male threaded extension into the mating recess of the arrow and screwing the arrowhead to the desired torque. The arrow is then ready for use.

6. Use

Figure 3:
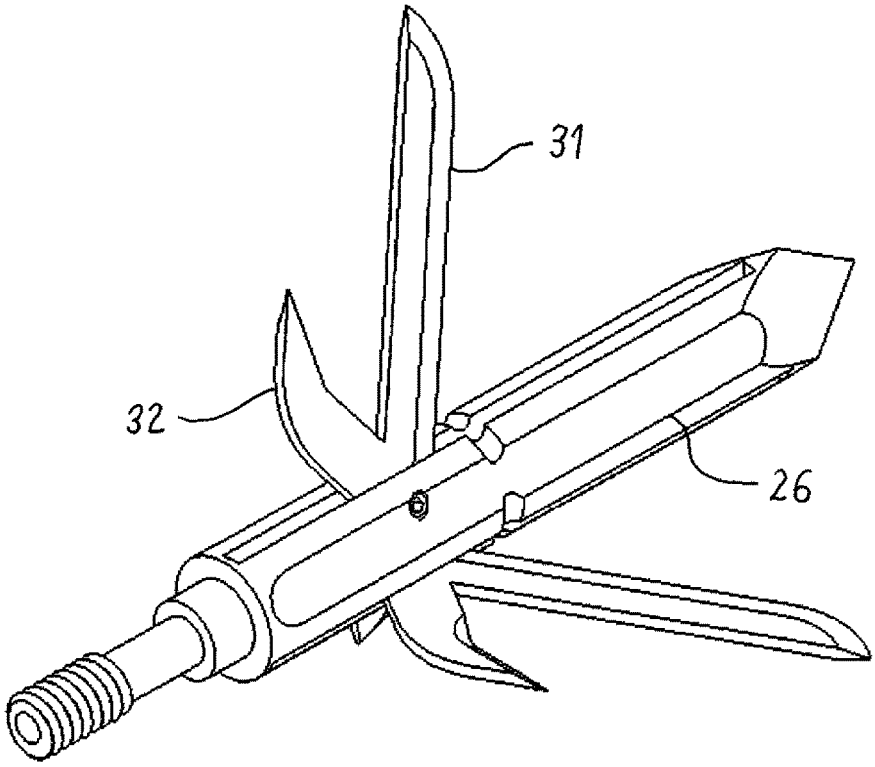
FIG. 3 is a perspective view thereof with the blades in a partially-deployed position.
Figure 4:
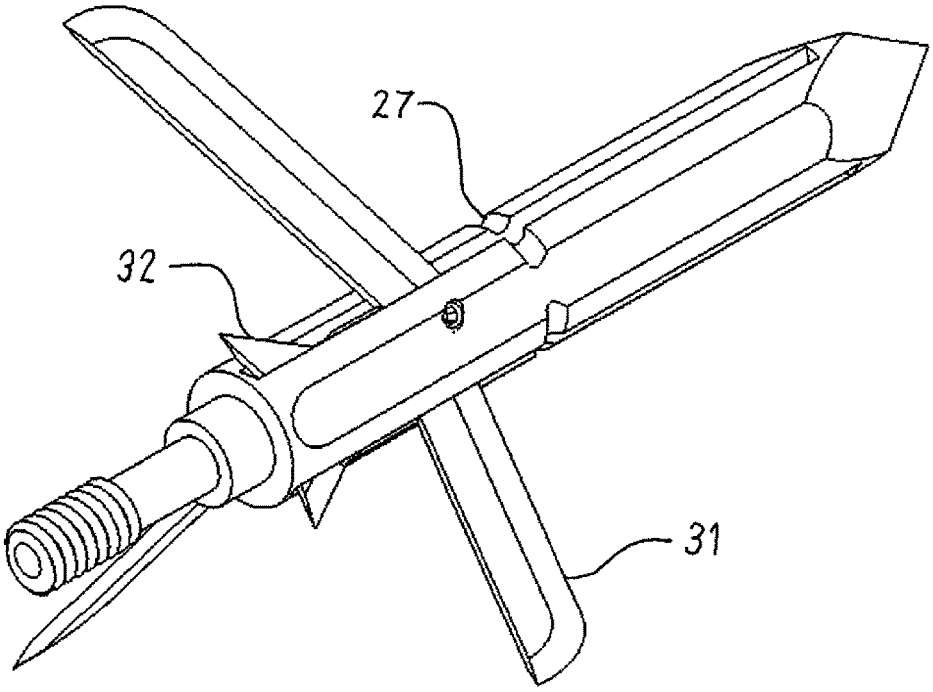
FIG. 4 is a perspective view thereof with the blades in a fully-deployed position.
Figure 5:
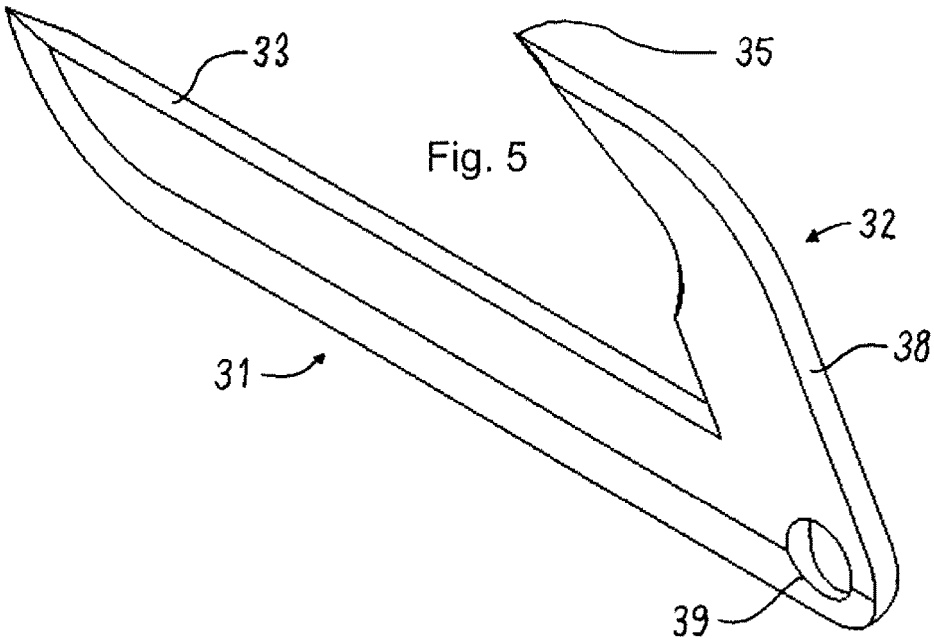
FIG. 5 is a top, rear, and right side perspective view of a blade thereof.
Figure 6:
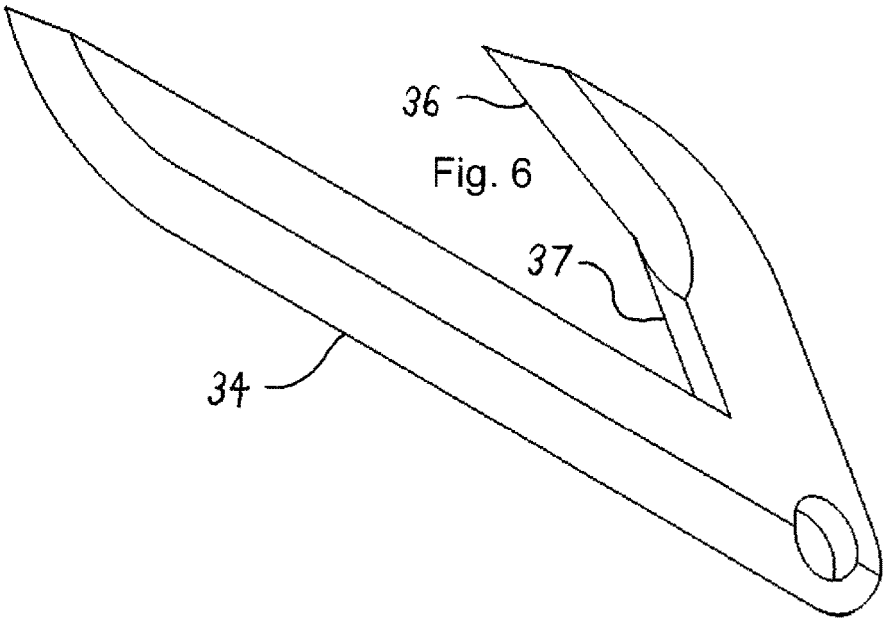
FIG. 6 is a bottom, front, and right side perspective view thereof.
Figure 12:
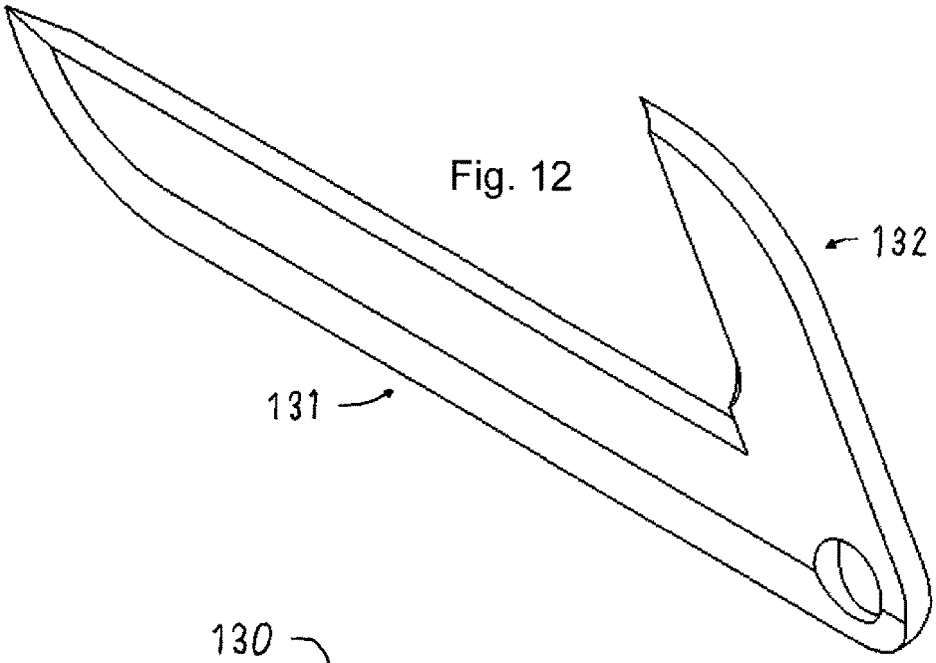
FIG. 12 is a top, rear, and right side perspective view of a second embodiment of a blade for the arrowhead.
Figure 13:
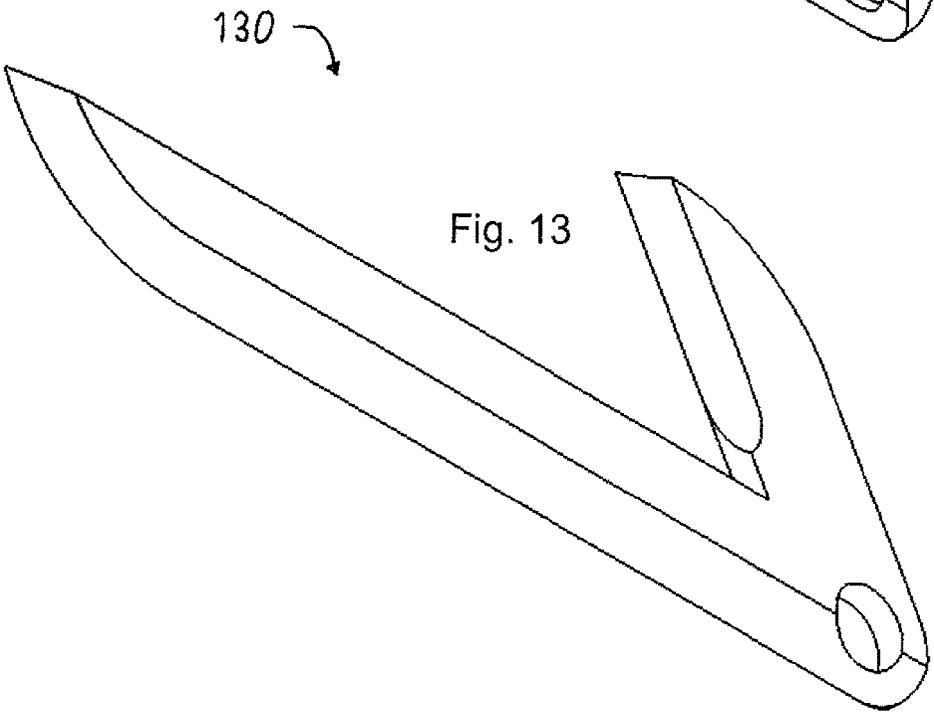
FIG. 13 is a bottom, front, and right side perspective view thereof.
Figure 14:
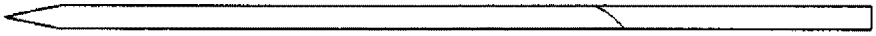
FIG. 14 is a top plan view thereof.
Figure 15:
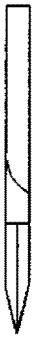
FIG. 15 is a front elevation view thereof.
Figure 17:
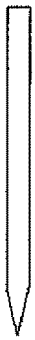
FIG. 17 is a rear elevation view thereof.
Figure 16:
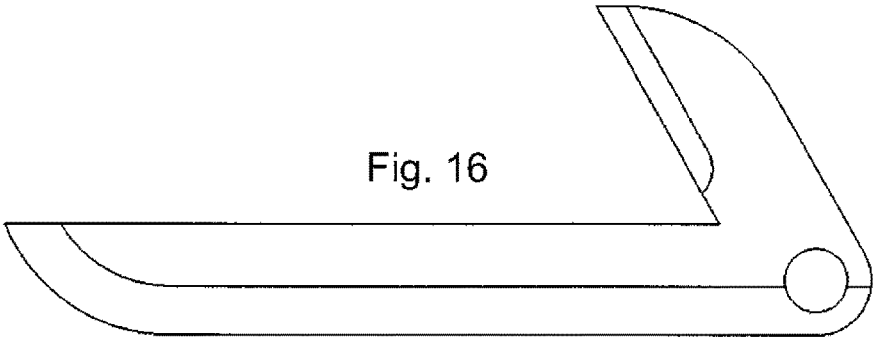
FIG. 16 is a right side elevation view thereof.
Figure 18:
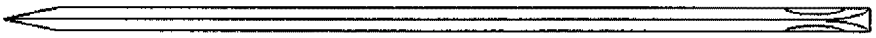
FIG. 18 is a bottom plan view thereof.

The arrowhead is aimed and shot using conventional methods. When the arrowhead penetrates the target animal, the tip penetrates in a conventional manner to a depth of about one inch. At that depth, the sharpened points on the wing portions of the blades make initial contact with the exterior surface of the animal. The majority of the kinetic energy of the arrow is focused on these sharpened points which easily penetrate through the surface and begin to create an entry hole. As the arrowhead continues to penetrate, the contact of the O-ring and the flat sides of the wing portions causes the O-ring to be pushed back or broken and simultaneously causes the blades to begin to deploy as shown in FIG. 3 (O-ring not shown). During deployment, the associated edges of the sharpened point efficiently cut around the ribs or any other bones rather than through the bones and create the remainder of the entry hole as the blades continue to deploy. As the blades reach their fully deployed position shown in FIG. 4 (O-ring not shown), the arrowhead has three outwardly extending knives with their sharp leading edges creating an internal channel that is much larger than the entry hole. The internal channel is typically about twice the diameter of the entry hole. If the O-ring did not break during deployment, the resistance of the target will cause the O-ring to continue to be pushed back and cut by the edges of the wing portion of the blade.

Figure 19:
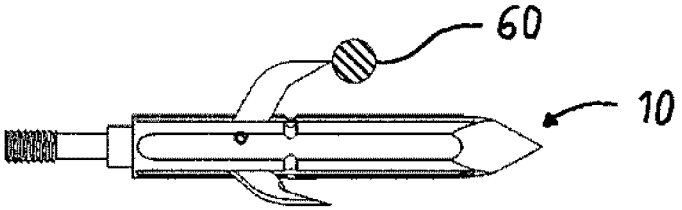
FIG. 19 is a diagram of the arrowhead and a solid object at a first depth of contact.
Figure 20:
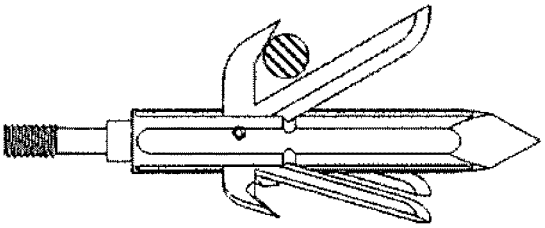
FIG. 20 is a diagram thereof at a second depth.
Figure 21:
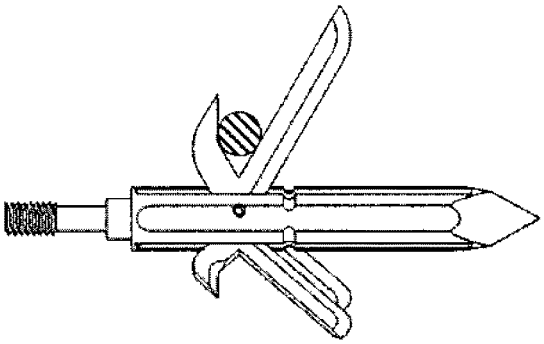
FIG. 21 is a diagram thereof at a third depth.
Figure 22:
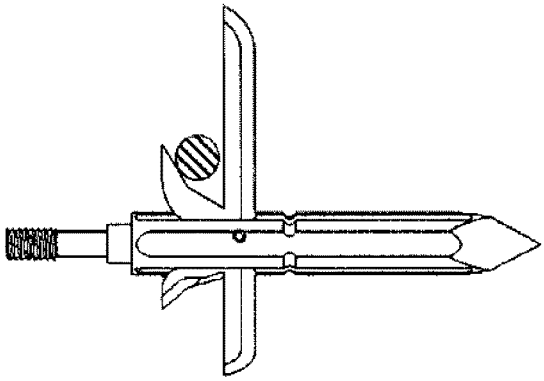
FIG. 22 is a diagram thereof at a fourth depth.
Figure 23:
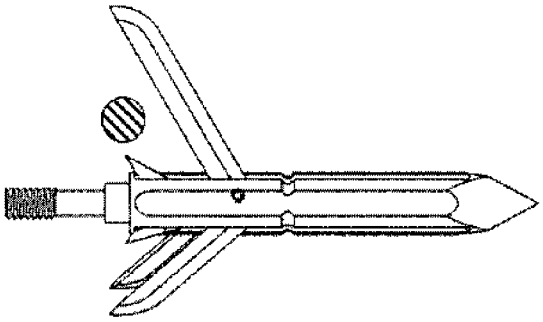
FIG. 23 is a diagram thereof at a fifth depth.

The mechanism of deployment of the blades 30 upon contact with a solid object 60, such as a rib or other bone, is illustrated in FIGS. 19 to 23. FIG. 19 is a representation of the initial contact between the tip of the wing portion and the object. At this point, the blades have not yet begun to deploy. Rather than cutting through the object and expending a tremendous amount of kinetic energy, the blade is now able to deploy as shown in FIGS. 20 to 22. The delayed deployment enables the arrowhead to pass by the object without having to cut through it. FIG. 23 shows the arrowhead as it passes the object with the blades fully deployed and still possessing a substantial portion of the kinetic energy with which it first contacted the target animal.

In the case of the arrowhead being used to hunt larger game, it can be appreciated that the delayed deployment of the blades enables the arrowhead to pass through the hair, hide, and ribcage of the animal with little decrease in energy while maintaining a sizeable entry hole. The longer knife portion of the blades then deploy immediately after the ribcage as the arrowhead enters the first lung or other internal organs, causing massive trauma and rapid death to the animal.

7. Theory of Operation

While not wishing to be bound by theory, it is believed that the broadhead arrowhead of this invention demonstrates improved energy conservation through the tough exterior of the target animal and utilizes improved cutting techniques upon entry into the target animal for two reasons. First, the pivot point of the blade is located where the centerline of the knife portion intersects the centerline of the wing portion. This location provides a more efficient transfer of the force applied by the animal's exterior to the rotational deployment of the blade and also allows the wing to slice around bone rather than through it. Second, the leading edge of the wing portion is sharpened along at least some of its length and this leading edge is at such an angle to provide efficient penetration. This enables the wing portion to enter the target animal with reduced drag while still ensuring that the blade is deployed.

I claim:

1. A mechanical broadhead arrowhead comprising:

(a) an elongated body defining a longitudinal axis, the body having a forward end with a sharpened tip, a threaded rearward end for attachment to a shaft of an arrow, and a plurality of recessed slots parallel to the longitudinal axis; and (b) a plurality of delayed deployment blades pivotably mounted in the slots, each blade having a longer knife portion with a centerline and a shorter wing portion with a centerline, the knife portion having a sharpened edge along the side opposed from the wing portion, the wing portion having a sharpened edge along at least part of the side facing the knife portion, each blade having a pivot point where the centerline of the knife portion intersects the centerline of the wing portion, the centerline of the knife portion and the centerline of the wing portion forming an angle of about 45 to 75 degrees, each blade adapted to rest in a first position with its knife portion in a slot of the body and with its wing portion extending outwardly with its sharpened edge facing forward and being forward of the pivot point during flight, and each blade adapted to move to a second position with its wing portion in a slot of the body and its knife portion extending outwardly with its sharpened edge facing forward after deployment upon contact with a solid target.

2. The arrowhead of claim 1 wherein the body is generally cylindrical.

3. The arrowhead of claim 1 wherein the number of recessed slots is two to four.

4. The arrowhead of claim 1 wherein the body contains a plurality of flutes.

5. A mechanical broadhead arrowhead comprising:

(a) an elongated, generally cylindrical body defining a longitudinal axis, the body having a forward end with a sharpened tip, a rearward end having a means for attachment to a shaft of an arrow, and a plurality of recessed slots parallel to the longitudinal axis; and (b) a plurality of delayed deployment blades pivotably mounted in the slots, each blade having the general shape of a sans serif capital letter J with a longer knife portion with a centerline and a shorter wing portion with a centerline, the knife portion having a sharpened edge along the side opposed from the wing portion, the wing portion having a sharpened edge along the side facing the knife portion, each blade having a pivot point where the centerline of the knife portion meets the centerline of the wing portion, each blade adapted to rest in a first position with its knife portion in a slot of the body and its wing portion extending outwardly and forward of the pivot point during flight and each blade adapted to move to a second position with its wing portion in a slot of the body and its knife portion extending outwardly after deployment upon contact with a solid target.

6. The arrowhead of claim 5 wherein the centerline of the knife portion and the centerline of the wing portion form an angle of about 45 to 75 degrees.

7. The arrowhead of claim 5 wherein the number of recessed slots is two to four.

8. The arrowhead of claim 5 wherein the body contains a plurality of flutes.

* * * * *